US007686659B2

(12) United States Patent
Peng

(10) Patent No.: US 7,686,659 B2
(45) Date of Patent: Mar. 30, 2010

(54) BATTERY CONNECTOR ASSEMBLY

(75) Inventor: Bin Peng, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 827 days.

(21) Appl. No.: 11/480,130

(22) Filed: Jun. 29, 2006

(65) Prior Publication Data

US 2007/0004271 A1 Jan. 4, 2007

(30) Foreign Application Priority Data

Jul. 2, 2005 (CN) ..... 2005 2 0073358 U

(51) Int. Cl.
*H01R 13/64* (2006.01)

(52) U.S. Cl. ..... 439/680; 439/660

(58) Field of Classification Search ..... 439/660, 439/500, 567, 144, 327, 354, 345, 680; 320/107, 320/114

See application file for complete search history.

(56) References Cited

U.S. PATENT DOCUMENTS 5,246,380 A * 9/1993 Kodama ..... 439/354
5,356,300 A 10/1994 Costello et al.
5,470,255 A 11/1995 McCleerey et al.
6,027,353 A 2/2000 Kamagai
6,302,744 B1 * 10/2001 Nomura ..... 439/680
6,383,023 B1 * 5/2002 Chang et al. ..... 439/607
6,468,108 B1 * 10/2002 Wu ..... 439/567
6,533,601 B2 * 3/2003 Raudenbush et al. ..... 439/352
6,672,887 B1 1/2004 Yu
2004/0018772 A1 * 1/2004 Zhang et al. ..... 439/607

FOREIGN PATENT DOCUMENTS

TW M272272 8/2005

* cited by examiner

*Primary Examiner*—Edwin A. Leon
*Assistant Examiner*—Vanessa Girardi
(74) *Attorney, Agent, or Firm*—Andrew C. Cheng; Wei Te Chung; Ming Chieh Chang

(57) ABSTRACT

A battery connector assembly (100) includes a first connector (200) and a second connector (300). The first connector includes an insulating housing (1) defining an elongate end face (102) and a tongue portion (11) projecting forward from and extending along a longitudinal direction of the end face. A plurality of signal contacts (21) extends on the tongue portion and power contacts (22) of blade shape are projected from the end face and vertical to the longitudinal direction. The second connector is mated with the first connector.

14 Claims, 7 Drawing Sheets

BATTERY CONNECTOR ASSEMBLY

BACKGROUND OF THE INVENTION

1. Field of the Invention

The present invention relates to a battery connector assembly, and more particularly to a connector assembly for a rechargeable battery used in portable electronic equipment.

2. Description of the Related Art

U.S. Pat. No. 5,470,255 discloses a battery assembly for a rechargeable battery including a female and a male connector. The female connector includes an insulating package 3, four battery cells 4 contained in the package and a row of four terminals 5, 6, 7, 8. The power terminals 5, 8 are used to connect with the positive and negative polarities of the battery cells 4. The data terminal 6 is for connection of electronic data to an electronic charging control circuit. The charging terminal 7 is for connection of a charging transformer controlled by a thermistor. As best shown in FIGS. 5-8 of U.S. Pat. No. 5,470,255, the four terminals are of two resilient arms configuration and received in the recesses 22 recessed from the end and bottom side of the package. The male connector 24 mated with the female connector is positioned in electronic equipment. The male connector comprises an insulating housing and contacts 36 of blade shape retained in and projected from the housing to electrically engage with corresponding terminals of the female connector.

The battery connector assembly is used for a supply of electrical voltage to the equipment, with a results that the power contacts transferring a larger current are blade form and larger in dimension. The remaining contacts transferring data or controlling signal are adapted for a smaller power current transmission. But, to provide enough retention of terminals and contacts when the female and male connectors engage with each other, the remaining contacts also are designed with blade shape and arranged in row with the power contacts.

But, the arrangement of the male contacts in row will increase size of the connector, especially when the number of the male contacts is larger.

Hence, an improved battery connector assembly is desired to overcome above problems.

BRIEF SUMMARY OF THE INVENTION

It is an object of the present invention to provide a battery connector assembly having smaller pitch of terminals and contacts.

In order to obtain the objective above, a battery connector assembly for a rechargeable battery includes a first connector and a second connector. The first connector includes an insulating housing comprising a base portion defining an end face and a board-shaped tongue portion extending forwards from the end face. Contacts of first type are partially arranged on the tongue portion and two blade-shaped contacts of second type are projected forwards from end face and spacing vertically from the tongue portion. The second connector comprises an insulating housing defining an end face and comprising a mating cavity and two slits recessed from said end face thereof. Terminals of first type are arranged in the mating cavity to engage with the contacts of first type of the first connector and two terminals of second type are received in the slits to engage with the contacts of second type of the first connector. When two connectors mate together, the tongue portion is inserted into the mating cavity and the contacts of second type of the first connector are inserted in the slits.

Other objects, advantages and novel features of the invention will become more apparent from the following detailed description of the present embodiment when taken in conjunction with the accompanying drawings.

DETAILED DESCRIPTION OF THE INVENTION

Figure 1:
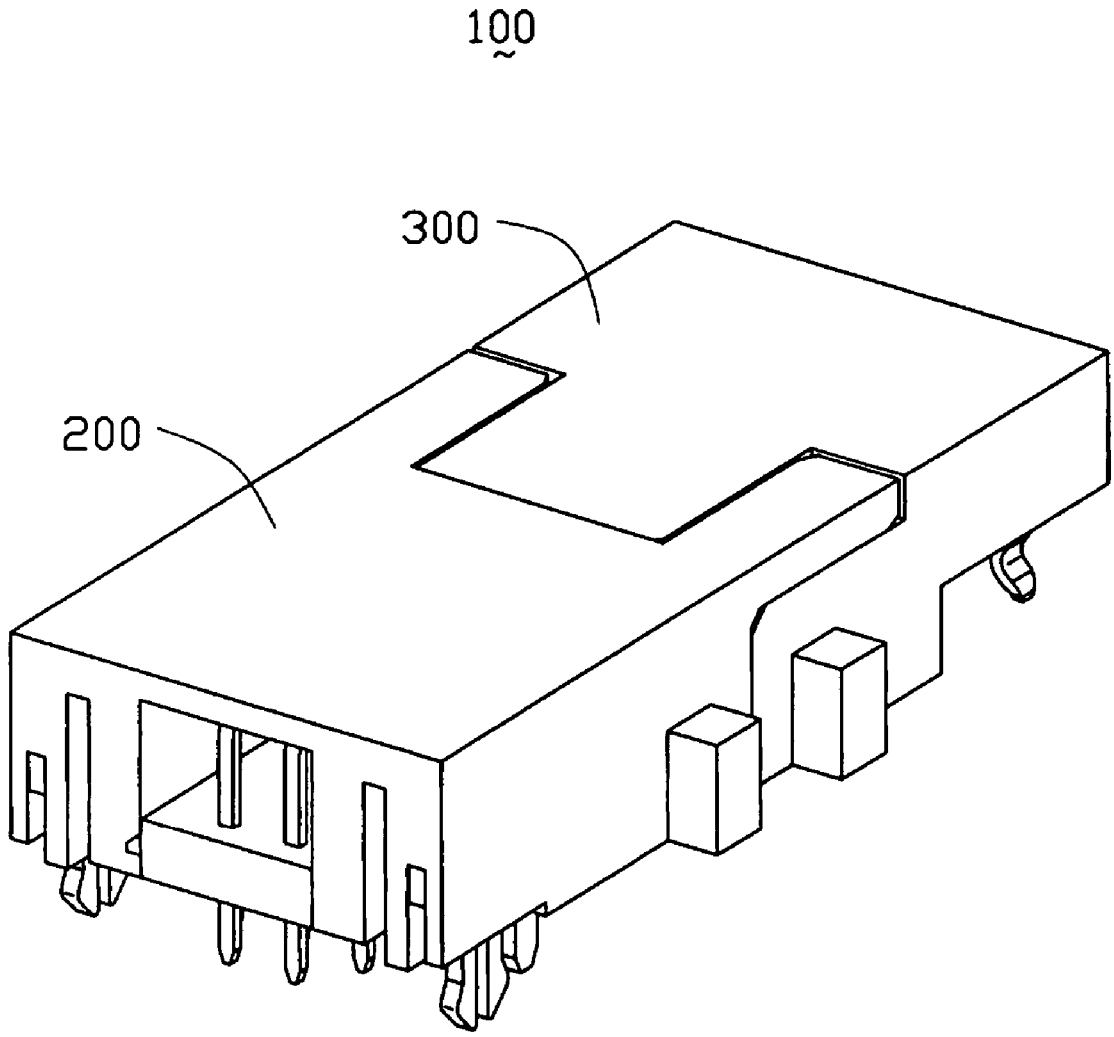
FIG. 1 is a perspective view of a mated battery connector assembly having a male and female connectors according to an embodiment of the present invention.
Figure 2:
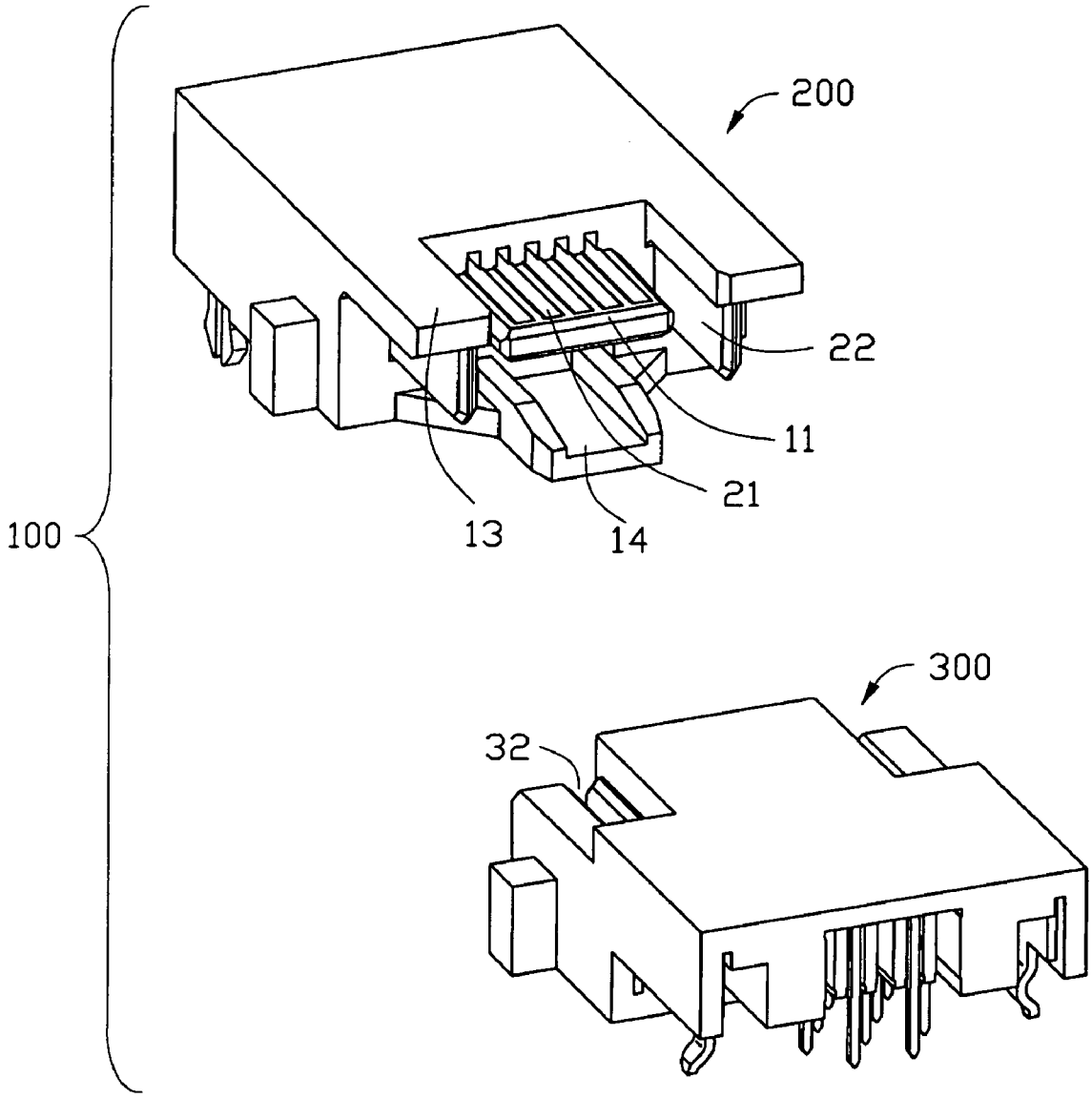
FIG. 2 is a perspective view of the battery connector assembly, wherein the female and male connectors are unmated.

Referring to FIGS. 1-2, a battery connector assembly 100 for a rechargeable battery according to one embodiment of the present invention includes a male connector 200 and a female connector 300 mating with each other.

FIGS. 3, 5-6, 9-10 shows the male connector 200 in different views. A description will be given hereinafter.

Figure 3:
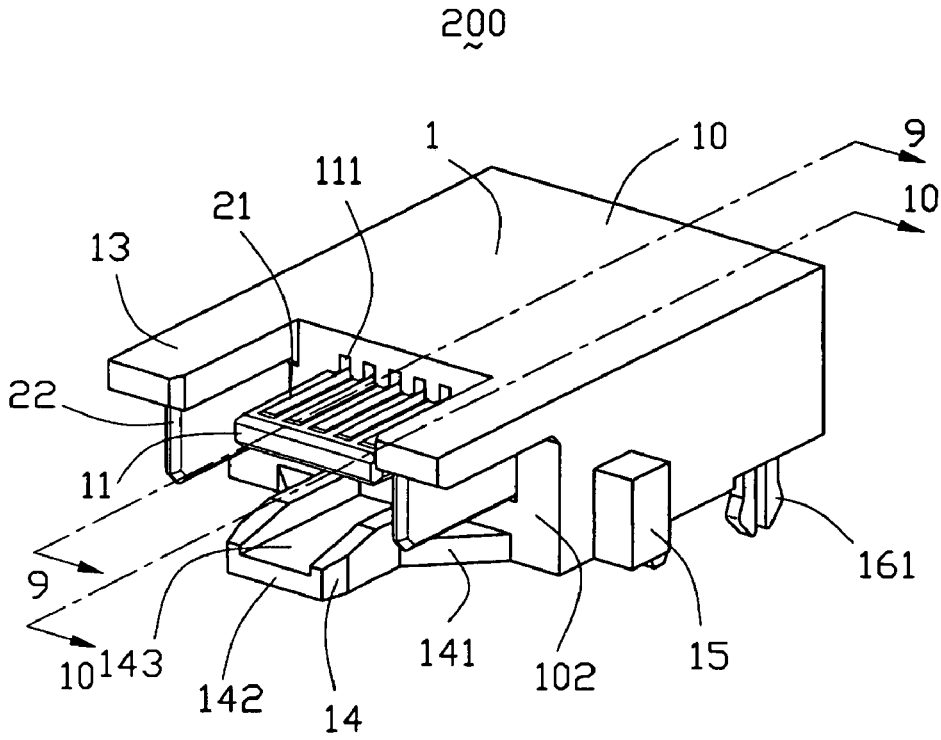
FIG. 3 is a perspective view of the male connector showing in FIG. 2 taken from another direction.
Figure 5:
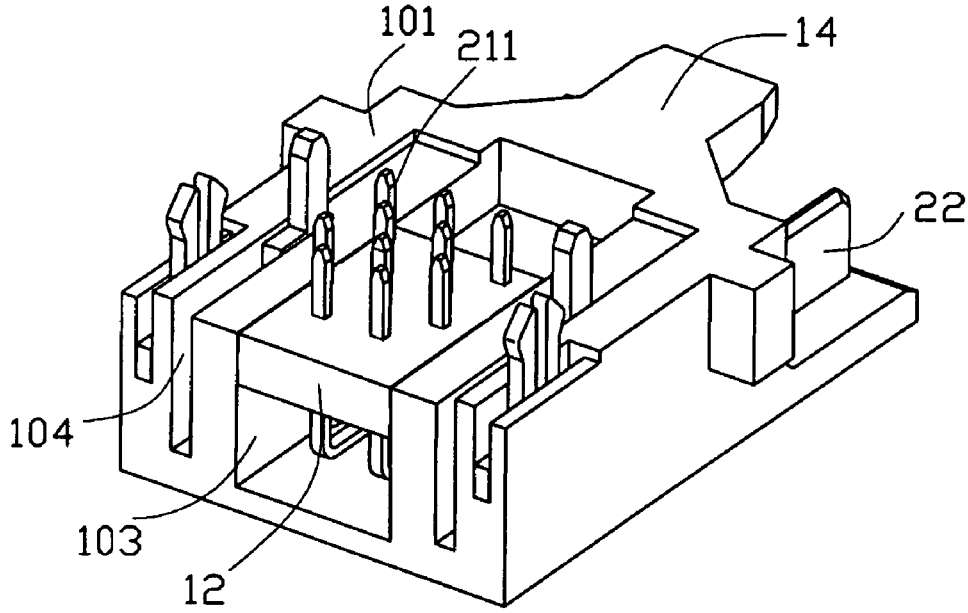
FIGS. 5-6 are bottom perspective views of the male connector showing in FIG. 2 in different directions.
Figure 6:
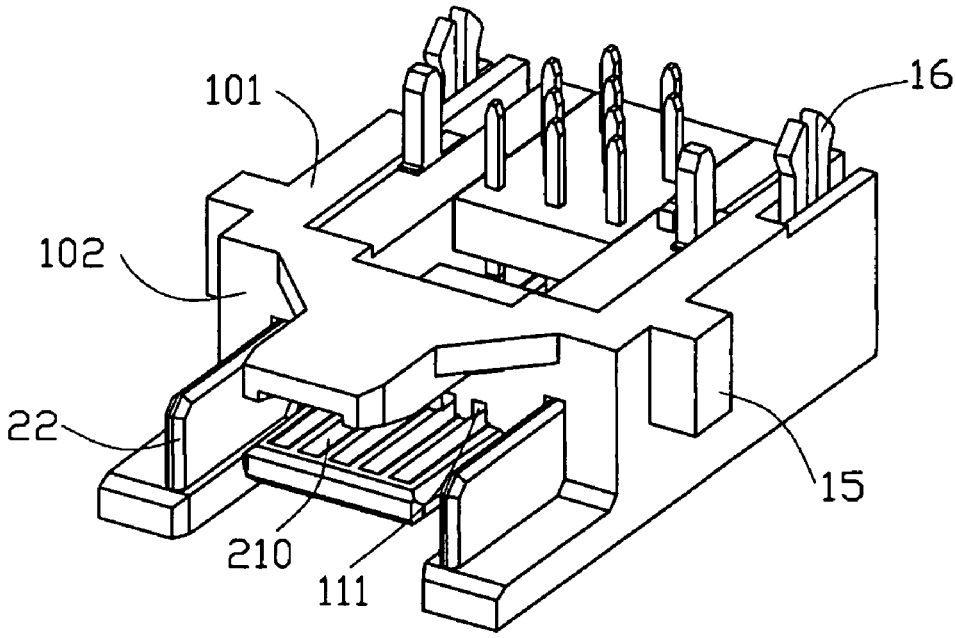

Referring to FIG. 3, the male connector 200 comprises an insulating housing 1 and a plurality of contacts retained in the housing. The insulating housing 1 defines a rectangular base portion 10, which has a bottom face 101 (shown in FIGS. 5-6) to face a PCB in a portable electronic equipment (not shown) and an end face 102 perpendicular to the bottom face 101. A direction perpendicular to the end face is defined as a front-back direction herein. A board-shaped tongue portion 11 is projected forwards from and extends in the lengthwise direction of the end face 102. The tongue portion 11 defines a plurality of passageways 111 on its top and bottom sides in the front-back direction and the passageways 111 extend backwards until throughout the base portion 10. With reference to FIGS. 5-6, the base portion 10 defines a cutout 103 open to the bottom face 101 and a face opposite to the end face 102, and a spacer 12 retained in the cutout 103. Two slots 104 respectively are defined near to the cutout 103.

Figure 9:
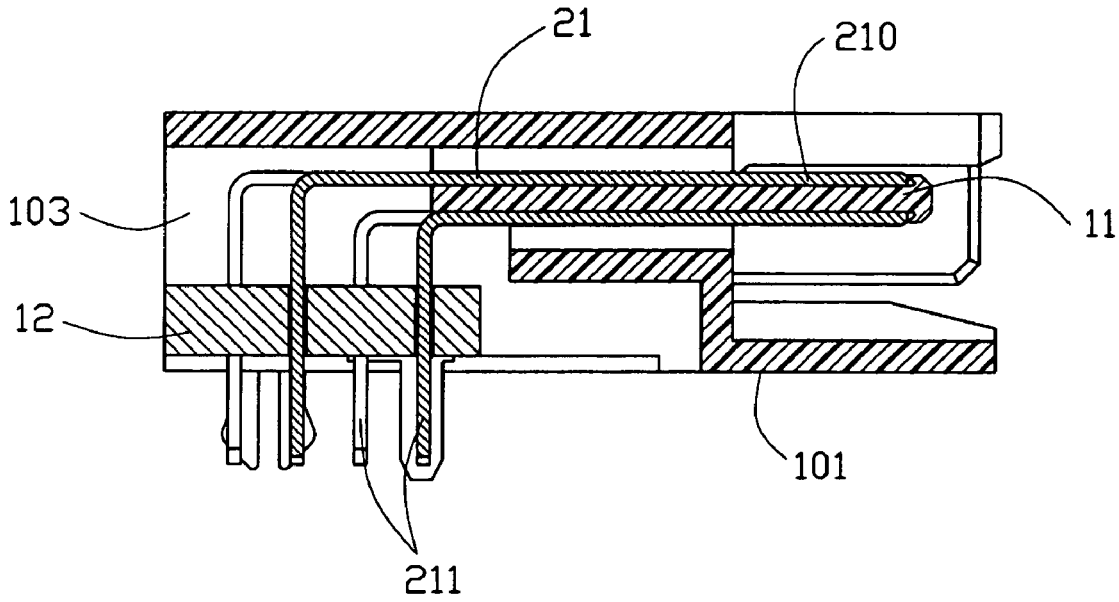
FIGS. 9-10 are cross-section views of the male connector showing in FIG. 3 taken along 9-9 and 10-10.

Contacts 21 of first type transferring a small current are retained in the housing as FIGS. 5 and 9 shown. Each contact 21 is L-shaped and slender, and comprises an engaging portion 210 positioned in the passages of the tongue portion 11 and a leg portion 211 throughout the spacer 12 to engage with the PCB (not shown).

Figure 10:
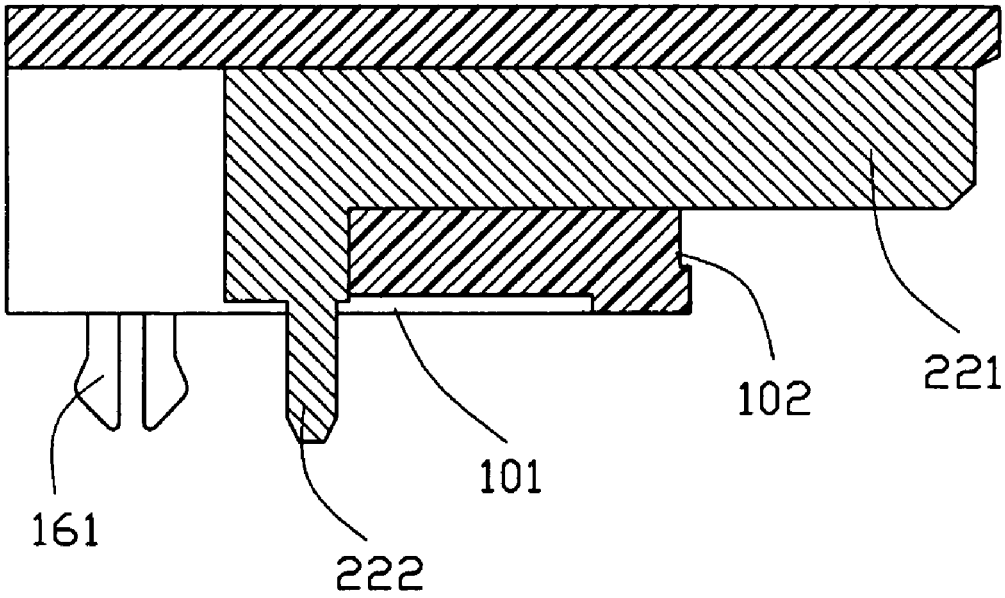

Referring to FIG. 3 again, the male connector 200 further has two blade-shaped contact 22 of second type projecting from the end face 102. As FIGS. 5 and 10 shown, each second contacts 22 comprises an engaging portion 221 and a leg portion 222 throughout the slot 104 of base portion 10 to engage with the PCB. The engaging portion 221 of the second type contact is larger than that of the first type contact 21 in width, so the second type contact can be provided a larger current transmission. The second type contacts 21 space vertically from the tongue portion 11 respectively, approximate with a same axis of the tongue portion 11. The base portion 10 defines two first engaging blocks 13 from a top edge of the end face 102. Top edges of the second type contacts 22 are embedded in the bottom sides of first engaging blocks 13, which will further strengthen retention of the second type contacts 22 with the housing 1. A second engaging block 14 extends forwards from a bottom edge of the end face 102 and parallel to the tongue portion 11. The second engaging block is proximate a bugle shape and includes a groove-shaped portion 142 and a pair of triangle-shaped portions 141 at the joints of the groove-shaped portion 142 with the end face 102. The groove-shaped portion 142 defines a groove 143 facing towards the tongue portion 11. The base potion 11 defines a flange 15 on sidewalls to retain the connector to the electronic equipment and a board-lock 161 abutting against the sidewalls. The first and second engaging blocks 13, 14 and the first and second type contacts 21, 22 commonly form a mating member of the male connector 200.

FIGS. 4, 7-8, 11-12 show the female connector 300 mating with said male connector 200 in different views. A description will be given hereainfter.

Figure 4:
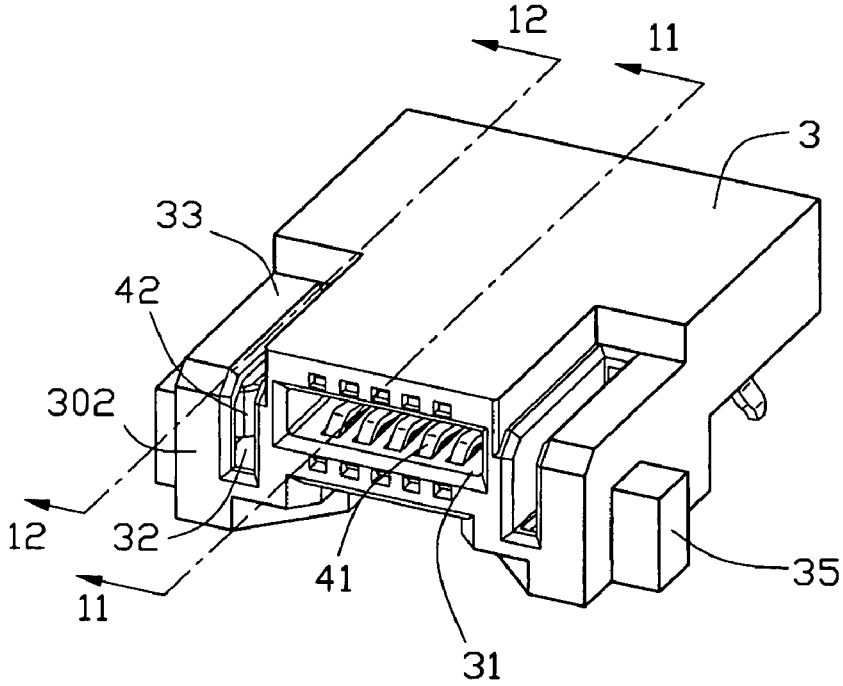
FIG. 4 is a perspective view of the female connector showing in FIG. 2 taken from another direction.
Figure 7:
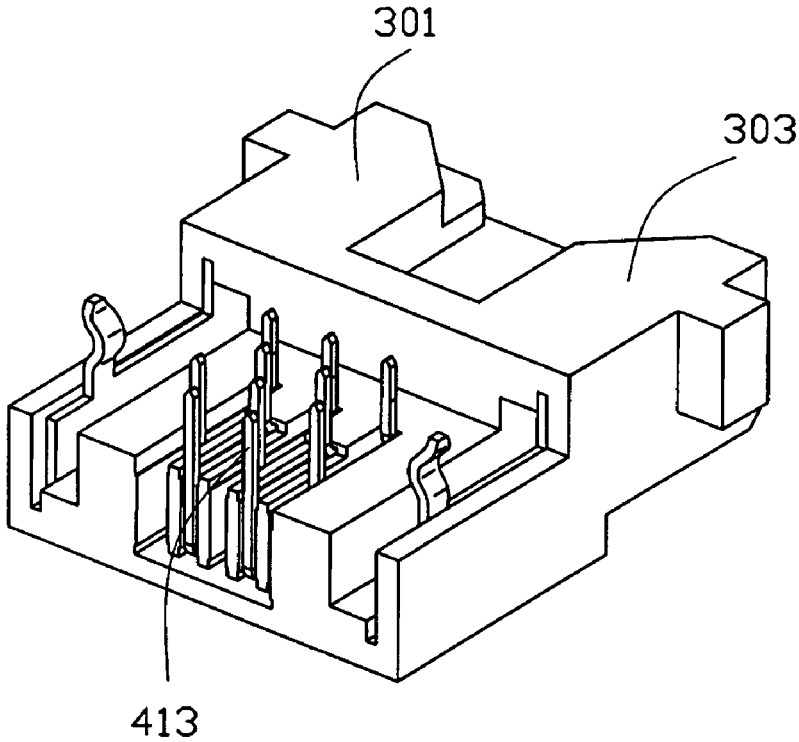
FIGS. 7-8 are bottom perspective views of the female connector showing in FIG. 2 in different direction.
Figure 8:
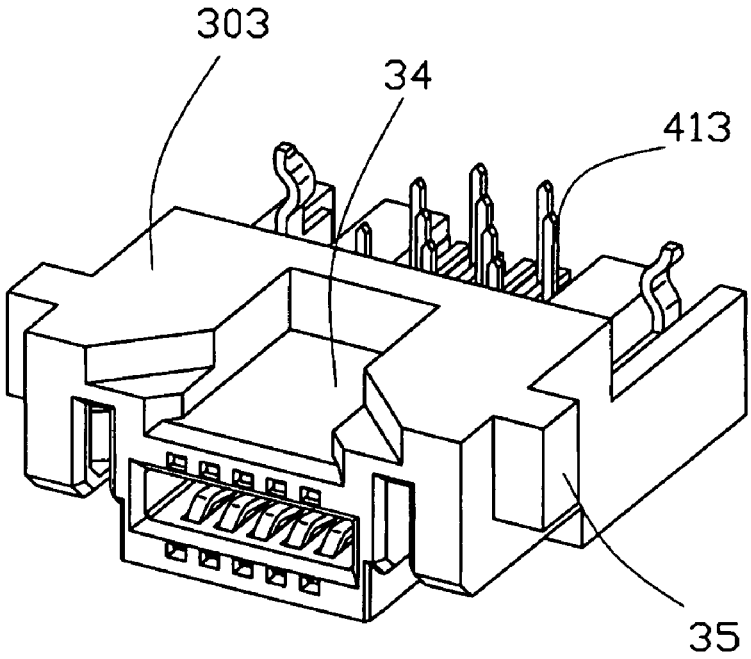
Figure 11:
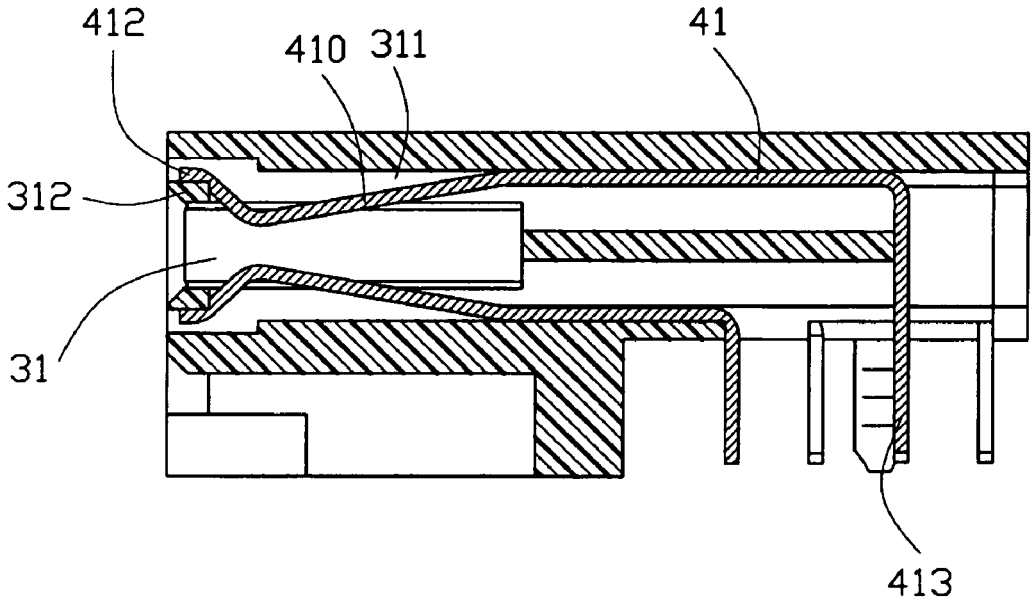
FIGS. 11-12 are cross-section views of the female connector showing in FIG. 4 taken along 11-11 and 12-12.
Figure 12:
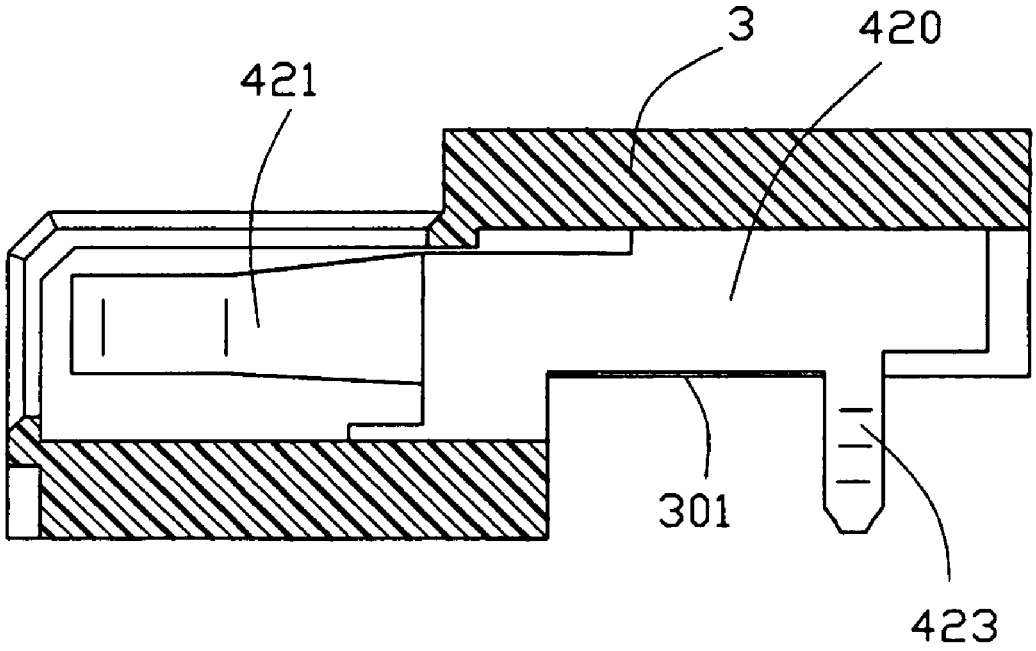

Referring to FIGS. 4 and 7-8, the female connector 300 comprises a rectangular insulating housing 3 and a plurality of terminals retained in the housing. The housing 3 has a bottom face 301 to assemble to a PCB of a battery package (not shown) and an end face 302 perpendicular to the bottom face. The bottom face 301 is a step form and its front portion 303 rise up above its back portion. The housing 1 defines a mating cavity 31 recessed from the end face 302 according to dimension of the tongue portion 11 of the male connector 200. Channels 311 are formed at the top and bottom sidewalls of the mating cavity 31 along the front-back direction and extend backwards until throughout the housing 3 as FIG. 11 shown. Terminals 41 of first type are slender and retained in the channels 311. Each terminal comprises a resilient engaging portion 410 extending into the cavity, with a front distal 412 being preloaded on a preload wall 312 at the entry of the cavity 31, and a leg portion 413 throughout the housing to engage the PCB. The housing further defines two slits 32 beside two opposite ends of the cavity 31. Each slit 32 extends throughout the housing and communicates with the end face 302. And two first engaging openings 33 are defined respectively on the slits to cooperate with the first engaging block, the openings 33 communicating with the slits and opening to the top face, end face 302 and the outsider wall of the slit. Two terminals 42 of second type of two arms configuration are retained in the slits 32. Each terminal includes a base portion 420 retained in the housing, an engaging portion 421 extending forwards from the base portion to slit and a leg portion 423 as FIG. 12 shown.

The front portion 303 of the housing 3 defines a second engaging opening 34 of bugle shape to receive the second engaging block 14 of the male connector 200.

With reference to FIGS. 1-4, when the male and female connector 200, 300 are mated with each other, the tongue 11 are inserted in the mating cavity 31 with the first type contacts and terminals 21, 41 engaging together to transfer a smaller current, and the second type contacts 22 are inserted into the slits engaging with the second type terminals 42 to transfer a larger, power current. At the same time, the first engaging blocks 13 are received in the first engaging openings 33, and the second engaging block 14 are received in the second engaging opening 34, which two will increase retention of two mated connectors.

Alternatively, the first engaging block 13 can be positioned parallelly to and separately away from the second type contacts 22 respectively. And the first and second engaging blocks 13, 14 also can be exchanged in position when space of the end face 102 of the male connector 200 permits.

Compared with conventional row-arrangement of the power and signal contacts, the arrangement of the first and second type contact of the invention decrease their pitch.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A battery connector comprising:

an insulating housing defining a front face and a tongue portion projecting forward from the front face;

a plurality of signal contacts arranged on the tongue portion along a transverse direction of the tongue portion;

a pair of power contacts having blade shaped engaging portions projecting from the front face, the engaging portions spatially located by two sides of the tongue portion along the transverse direction and perpendicular to the tongue portion;

wherein the insulating housing comprises a pair of engaging blocks unitarily projecting from the front face thereof and spatially separate from the tongue portion in which top edges of the engaging portions of the power contacts are embedded.

2. The battery connector according to claim 1, wherein the insulating housing comprises an engaging block spatially parallel to and under the tongue portion.

3. The battery connector according to claim 2, wherein the engaging block is of bugle shape.

4. A battery connector assembly comprising:

a first insulating housing defining a mating opening in a front portion thereof;

a plurality of first signal contacts disposed in the first housing with corresponding first contacting portions exposed in the mating opening;

two slit, one formed on each side of said mating opening and isolated from the mating opening in a transverse direction;

a pair of first non-signal contacts disposed in the slits, respectively; and an engaging opening formed under and aligned with the mating opening in a vertical direction perpendicular to said transverse direction while being isolated from the mating opening in said vertical direction; wherein the slits are open forwardly and upward to an exterior, while the engaging opening is open to the exterior forwardly and downwardly.

5. The battery connector assembly according to claim 4, further including:

a second insulative housing defining a mating tongue in a front portion thereof, and an engaging block spatially located under the mating tongue;

a plurality of second signal contacts disposed in the second housing and exposed on the mating tongue;

a pair of second non-signal contacts spatially located by two sides of the mating tongue; wherein the mating tongue is inserted into the mating opening, then engaging block is received in the engaging opening, and the second non-signal contacts are received in the corresponding slits and mechanically and electrically engage the corresponding first non-signal contacts, respectively.

6. The assembly as claimed in claim 5, wherein said mating tongue is upwardly exposed to an exterior before the first housing and the second housing are mated with each other.

7. The assembly as claimed in claim 4, wherein said engaging opening is isolated from said two slits in said transverse direction.

8. An electrical connector assembly comprising:

a first connector comprising:

an insulating housing comprising a board-shaped tongue portion;

a plurality of signal contacts arranged on the tongue portion along a transverse direction of the tongue portion;

a pair of power contacts with contacting portions located by two opposite sides of the tongue portion along the transverse direction, contacting portions spatially separate from and perpendicular to the tongue portion; and a second connector comprising:

an insulating housing defining a front mating cavity and two slits opening forwards and upwards;

a plurality of signal contacts arranged in the mating cavity;

a pair of power contacts received in the slits; wherein when two connectors mate with each other, the tongue portion of the first connector is inserted in the mating cavity to complete engagement of the signal contacts of said two connectors and the contacting portions of the power contacts of the first connector are inserted in the slits to engage with the power contacts of the second connector.

9. The electrical connector assembly according to claim 8, wherein the signal contacts of first connector are exposed on two opposite surfaces of the tongue portion.

10. The electrical connector assembly according to claim 8, wherein the insulative housing of the first connector defines a pair of first engaging members unitarily formed therefrom, in which top edges of the contacting portions are embedded, the first engaging members cover on the slits of the second connector upon mating of the two connectors.

11. The electrical connector assembly according to claim 10, wherein the insulative housing of the first connector defines a second engaging member unitarily formed therefrom, the second engaging member located under and parallel to the tongue portion.

12. The electrical connector assembly according to claim 11, wherein the insulative housing of the second connector defines an engaging opening, opening forwards and downwards to receive the second engaging member of the first connector.

13. The electrical connector assembly according to claim 12, wherein the second engaging member is of bugle shape.

14. The electrical connector assembly according to claim 13, wherein the second engaging member defines a groove-shaped portion and a pair of triangle-shaped portions at joints of the groove-shaped portion with the end face.

* * * * *